US005934963A

United States Patent [19]

Frizzell

[11] Patent Number: 5,934,963

[45] Date of Patent: Aug. 10, 1999

[54] SURFBOARD FIN QUICK RELEASE SYSTEM

[76] Inventor: Marvin Dean Frizzell, 645 W. Pine Ave., El Segundo, Calif. 90245

[21] Appl. No.: 09/130,674

[22] Filed: Aug. 6, 1998

[51] Int. Cl.[6] ..... B63B 1/00

[52] U.S. Cl. ..... 441/79; 114/138

[58] Field of Search ..... 441/74, 79; 114/126, 114/39.2, 90, 138

[56] References Cited

U.S. PATENT DOCUMENTS

| | | | |
|---|---|---|---|
| 4,904,215 | 2/1990 | Sherwood | 441/79 |
| 5,030,151 | 7/1991 | Beacham | 441/79 |
| 5,215,488 | 6/1993 | Bailey | 441/79 |
| 5,306,188 | 4/1994 | Skedeleski et al. | 441/79 |
| 5,464,359 | 11/1995 | Whitty | 441/79 |
| 5,493,989 | 2/1996 | Anderson | 114/138 |
| 5,503,581 | 4/1996 | McCullough | 441/79 |

*Primary Examiner*—Jesus D. Sotelo

*Attorney, Agent, or Firm*—Goldstein & Canino

[57] ABSTRACT

A surfboard fin quick release system, for use on a surfboard having a top surface and a fin having a tang, comprising a fin box submerged within the surfboard and a locking mechanism mounted to the fin tang. The fin box comprises a longitudinal channel having a vertical channel and a horizontal channel. The locking mechanism has a main shaft which extends vertically through the fin tang, a release handle fixed to the main shaft above the fin tang, and a locking base having a locking base flange, said locking base fixed to the main shaft below the fin tang. A coil spring extends around the main shaft between the release handle and the tang. When the fin is extending in the vertical channel, the locking base is selectively positioned by rotating the release handle so that the base flange extends into the horizontal channel to lock the fin within the fin box. The fin may be selectively repositioned along the longitudinal channel by pressing downward upon the release handle, or may be removed from the fin box by pressing downward upon the release handle and rotating said release handle so that the base flange does not extend in the horizontal channel such that the fin may be pulled upward clear of the fin box.

9 Claims, 4 Drawing Sheets

SURFBOARD FIN QUICK RELEASE SYSTEM

BACKGROUND OF THE INVENTION

The invention relates to a surfboard quick fin release. More particularly, the invention relates to a system for allowing a surfboard fin to be quickly and easily attached and detached.

Conventional surfboards typically include a fin adjacent to the tail thereof, extending along the centerline of the board, to provide dimensional stability and to maximize board performance. Two of the most common techniques for attaching the fin to the surfboard involve either attaching the fin to the board by means of fiber-reinforced resin around the base of the fin, or by the use of a so-called "fin box". Each of these approaches has significant disadvantages.

Glassing the fins to the board involves considerable labor costs and makes subsequent sanding and finishing of the board difficult. A further disadvantage of this fixing method is that the fiberglass fillet region at the base of the fin interferes with the hydrodynamics of the fins. This is believed to arise firstly from a reduction in the effective height of the fin, and from the outward flow of water caused by the fixing region, which in turn leads to turbulence and cavitation. As a result, the drive and bite afforded by the fins during turns is reduced, and the performance and speed of the board is limited.

A further disadvantage of the attachment of fins by "glassing-on" is that the fins must be present and fixed to the board during all final finishing stages of the board's manufacture, increasing labor costs and restricting the quality of the final finish of the board.

When installing a fin by using a standard fin box, a rectangular cavity is formed in the board by the use of a router, and the fin box is inserted into this cavity. The fin box comprises a slot for the reception of the base of the fin, with a wider portion forming a lower slot at its base into which may be slid a pin, mounted horizontally through the front of the fin, to fix the front of the fin in the box. The rear of the fin is fixed by means of a vertical screw through a rearwardly extending portion of the base of the fin, this screw being driven into a drilled and tapped plate located in the rear end of the lower slot.

The use of standard fin boxes involves many disadvantages, including costly and labor-intensive fitting, and an increase in the weight of the board. These disadvantages of the fin box system, and others are well known, and have lead to the general demise of this system.

The fin box does offer a theoretical advantage over the glassing-on of fins, in the removability of the fins if they need replacement, for either repair or during travel. In practice however, removal and replacement is difficult, and thus this potential advantage is not realized.

While these units may be suitable for the particular purpose employed, or for general use, they would not be as suitable for the purposes of the present invention as disclosed hereafter.

SUMMARY OF THE INVENTION

It is an object of the invention to produce a fin attachment system for a surfboard, which allows the fin to be quickly and easily attached and detached from the surfboard. Accordingly, a surfboard quick fin release system is disclosed.

It is another object of the invention to provide a surfboard quick fin release system which allows the relative positioning of the fin and the surfboard to be longitudinally adjusted. Accordingly the fin box comprises a channel which allows slidable movement of the fin therein.

It is a further object of the invention to provide a surfboard quick fin release system which allows adjustment and removal to be quickly and easily accomplished. Accordingly, a spring-loaded base lock selectively secures within the channel to hold the fin in place, and easily releases from the channel by pressing downward upon a release handle to allow movement of the fin along the channel. If the base lock is twisted ninety degrees, the fin may be easily removed from the surfboard.

The invention is a surfboard fin quick release system, for use on a surfboard having a top surface and a fin having a tang, comprising a fin box submerged within the surfboard and a locking mechanism mounted to the fin tang. The fin box comprises a longitudinal channel having a vertical channel and a horizontal channel. The locking mechanism has a main shaft which extends vertically through the fin tang, a release handle fixed to the main shaft above the fin tang, and a locking base having a locking base flange, said locking base fixed to the main shaft below the fin tang. A coil spring extends around the main shaft between the release handle and the tang. When the fin is extending in the vertical channel, the locking base is selectively positioned by rotating the release handle so that the base flange extends into the horizontal channel to lock the fin within the fin box. The fin may be selectively repositioned along the longitudinal channel by pressing downward upon the release handle, or may be removed from the fin box by pressing downward upon the release handle and rotating said release handle so that the base flange does not extend in the horizontal channel such that the fin may be pulled upward clear of the fin box.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
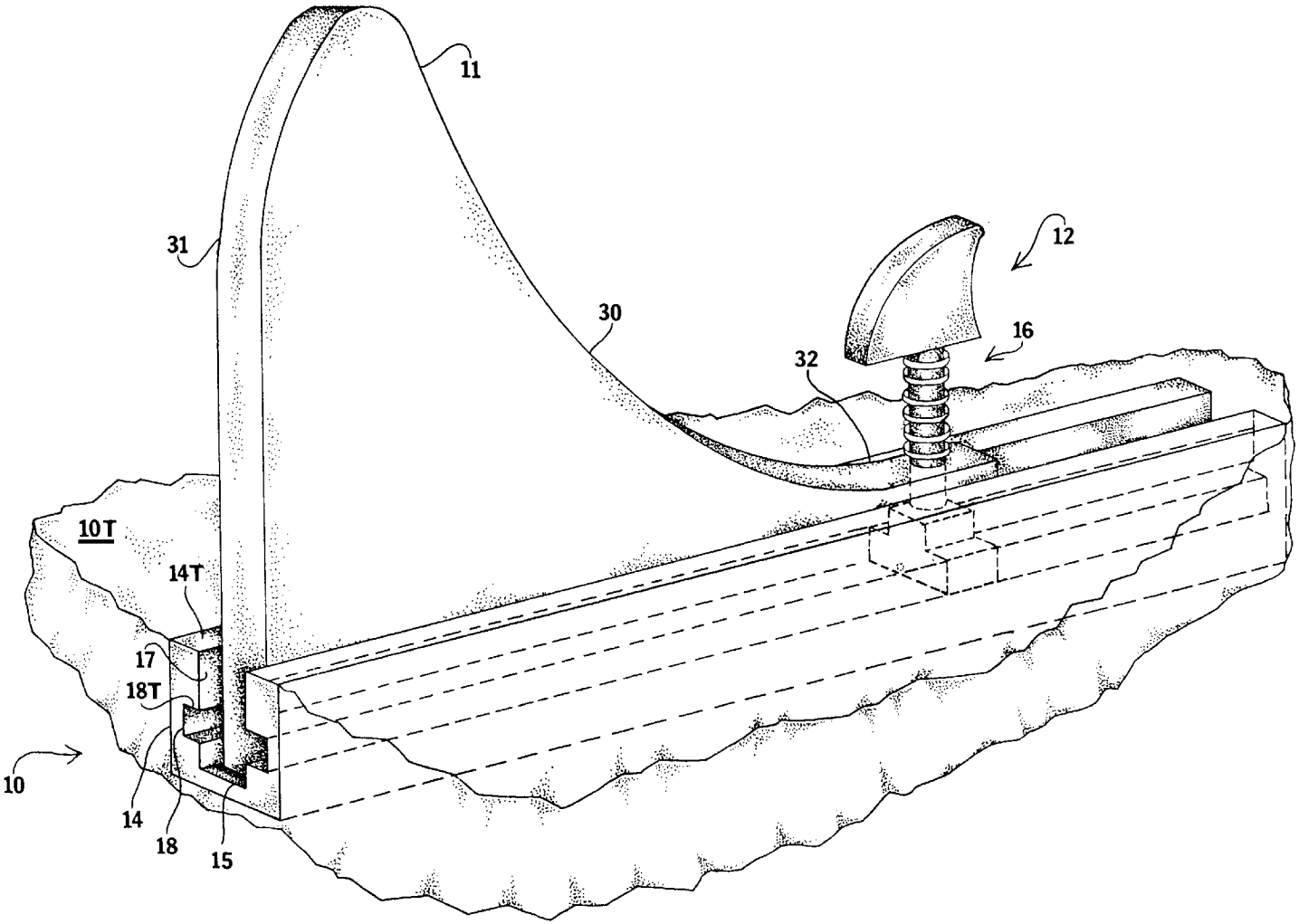
FIG. 1 is a diagrammatic perspective view, illustrating the invention being used to selectively adjust the position of a surfboard fin, hold it in place, and allow quick release thereof.

FIG. 1 illustrates a surfboard 10 having a top surface 10T and a fin 11. A surfboard quick release system 12 comprises a fin box 14 comprising a box top 14T and a longitudinal channel 15 which extends fully along the fin box 14. The fin box 14 is submerged within the surfboard 10 such that the box top 14T is flush with the top surface 10T of the surfboard 10. The longitudinal channel 15 comprises a vertical channel 17 and a horizontal channel 18, the vertical channel 17 and horizontal channel 18 provide an overall "plus" shaped cross section for the longitudinal channel 15.

The fin 11 extends longitudinally along and within the channel 15. The fin 11 has a fin width, a leading edge 30 and a trailing edge 31. The fin width is substantially as wide as the vertical channel 17. The fin 11 also has a tang 32 which extends from the leading edge 30 and curves upward so that it is becomes nearly parallel to the surfboard top surface 10T, and even therewith. A locking mechanism 16 is located on the tang 32 for selectively engaging with the channel 15 to lock the fin 11 in place within the fin box 14. Further details of the locking mechanism 16 will be disclosed hereinafter.

Figure 6:
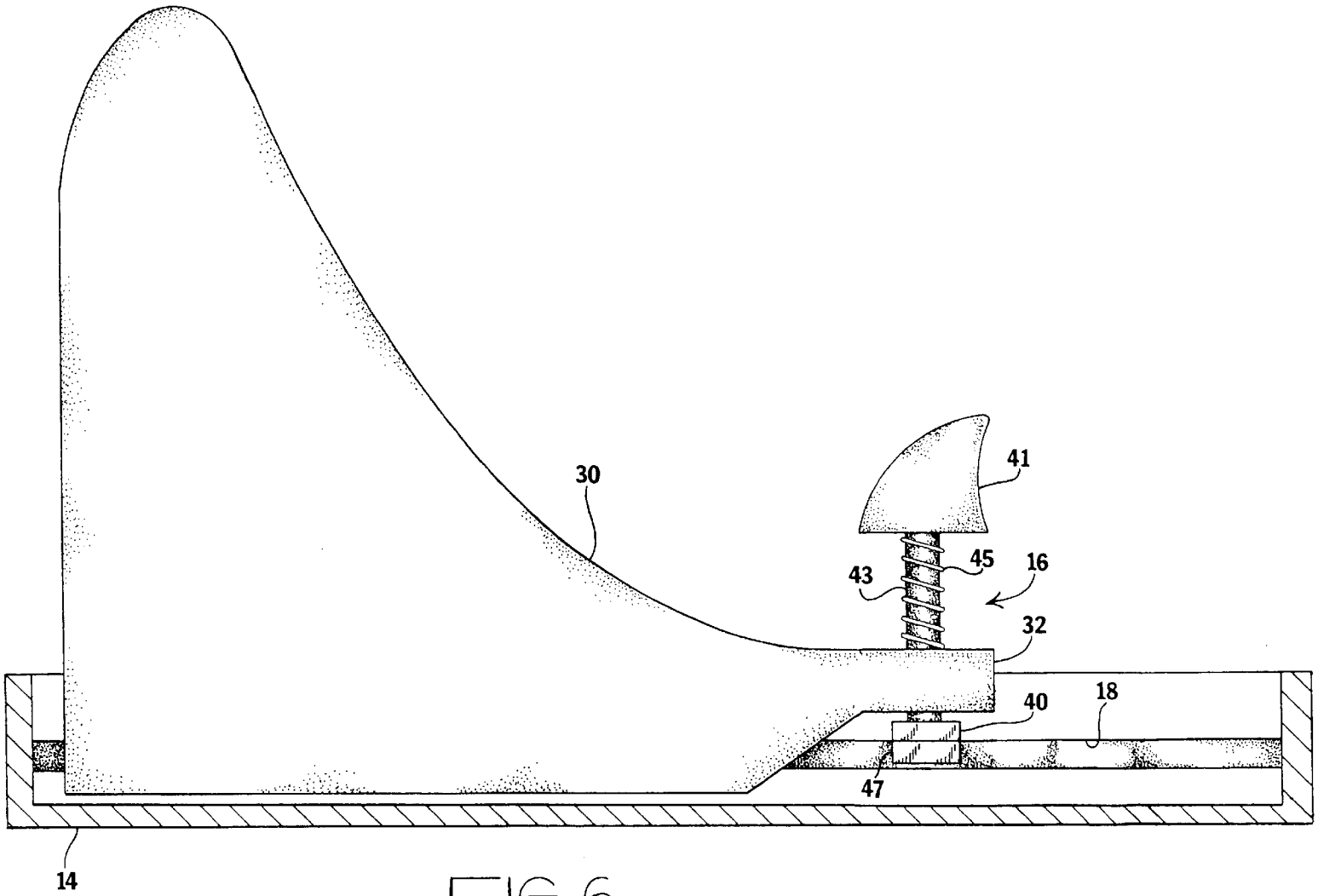
FIG. 6 is a cross sectional view, wherein a portion of the fin box has been removed to illustrate internal details of the invention that are located therein.

In FIG. 6, a portion of the fin box 14 has been removed. The locking mechanism 16 comprises a locking base 40, a release handle 41, and a main shaft 43 extending between the locking base 40 and the release handle 41. A coil spring 45 extends around the main shaft 43. The locking base 40 comprises a base flange 47. The base flange 47 extends into the horizontal channel 18.

FIG. 6 also reveals the configuration of the tang 32, which forms a ledge that extends from the leading edge 30. Essentially, the main shaft 43 extends vertically through the tang 32, with the locking base 40 located below the tang 32, and the release handle 41 located above the tang 32. Also, the spring is located on the main shaft 43 between the release handle 41 and the tang 32.

Figure 2:
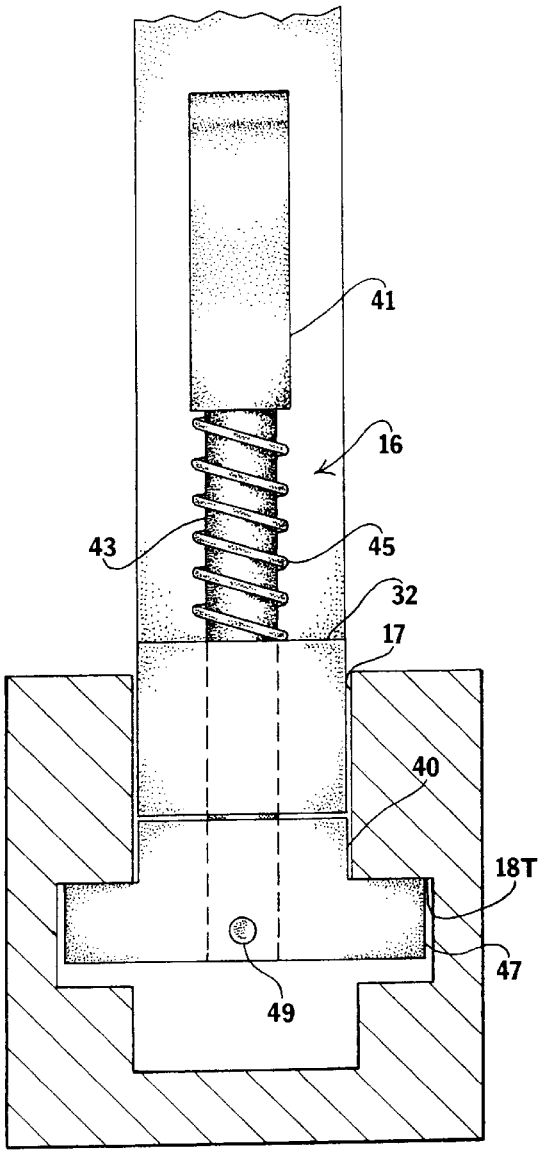
FIG. 2 is a cross sectional view, taken transversely through the fin box, illustrating the locking base in its locked position.

FIG. 2 illustrates the locking mechanism 16 in a locked position. As illustrated, the main shaft 43 extends through the locking base 40, and is fixed in relative position thereto with a roll pin 49 which extends through the locking base 40 and extends through the main shaft 43. Also illustrated, the main shaft 43 does not extend below the locking base 40.

The horizontal channel 18 has a horizontal channel top 18T. When in the locked position, the base flange 47 is tensioned against the horizontal channel top 18T by the spring 45. The spring 45 is tensioned between the release handle 41 and the tang 32, so that locking base 40 is pulled upward against the horizontal channel top 18T by tension within the spring 45. The upward force of the locking base 40 against the horizontal channel top 18T, and friction therebetween, prevents both longitudinal movement of the fin within the vertical channel 17 and the fin from being removed therefrom. FIG. 2 illustrates the normal positioning of the locking mechanism 16 during use of the surfboard.

Figure 3:
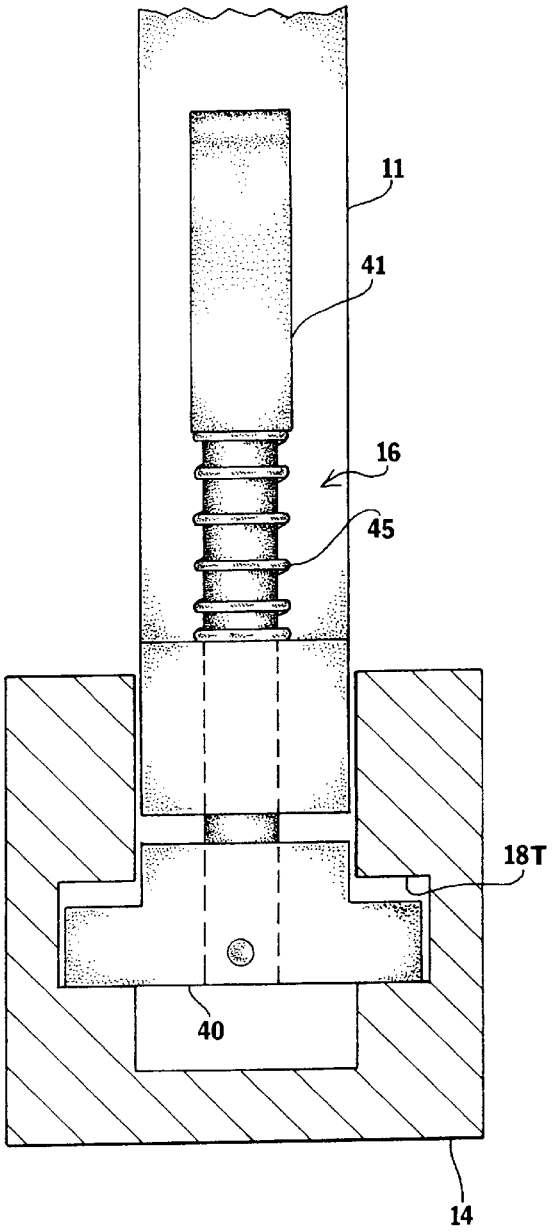
FIG. 3 is a cross sectional view similar to FIG. 2, except wherein the release handle has been depressed, lowering the locking base into an unlocked position.

In FIG. 3, the locking mechanism 16 is shown in an unlocked position. The release handle 41 has been pressed downward, compressing the spring 45, and moving the locking base 40 away from the horizontal channel top 18T. The fin 11 is now free to slide longitudinally within the fin box 14. If the user disengaged the release handle 41, the spring 45 would once again decompress, and enter the locked position shown in FIG. 2.

Figure 4:
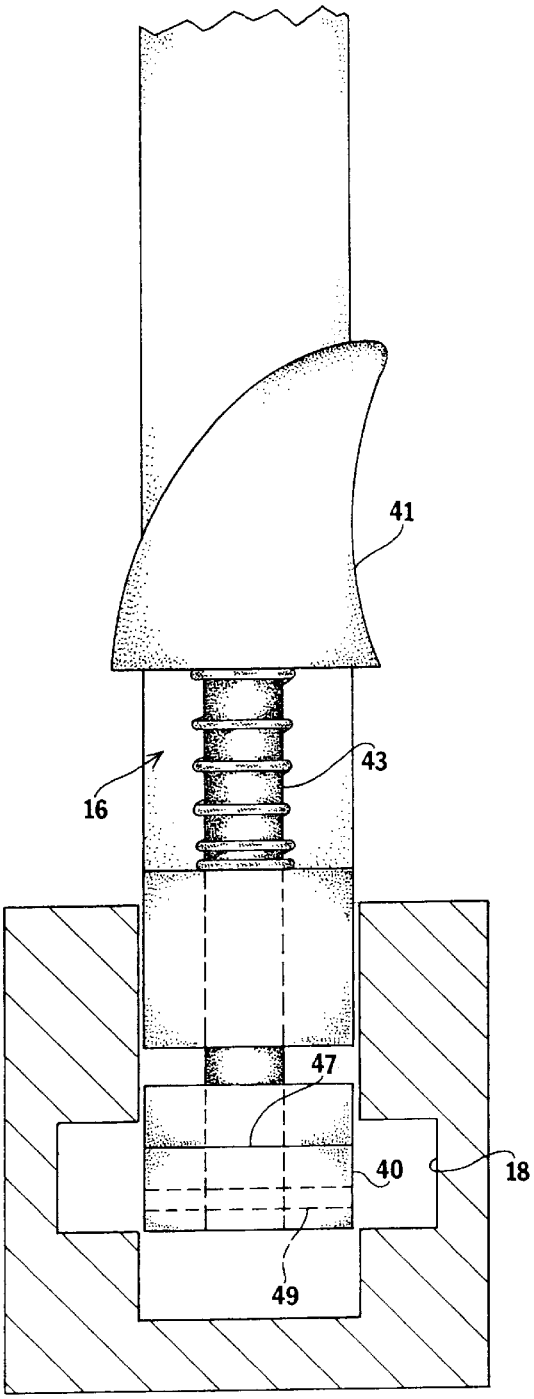
FIG. 4 is a cross sectional view, similar to FIG. 4, except wherein the base lock has been rotated ninety degrees, freeing the base lock.

FIG. 4 illustrates the locking mechanism 16 in a free position, wherein the locking base 40 has been rotated ninety degrees, so that the base flange 47 no longer extends into the horizontal channel 18. Thus, vertical movement of the fin 11 is no longer restricted. The locking base 40 is rotated by rotating the release handle 41 ninety degrees, which rotates the main shaft 43 ninety degrees, which in turn rotates the locking base 40 ninety degrees. FIG. 4 also illustrates how the roll pin 49 extends through the locking base 40 to fix the relative vertical and angular position of the main shaft 43 and locking base 40.

Figure 5:
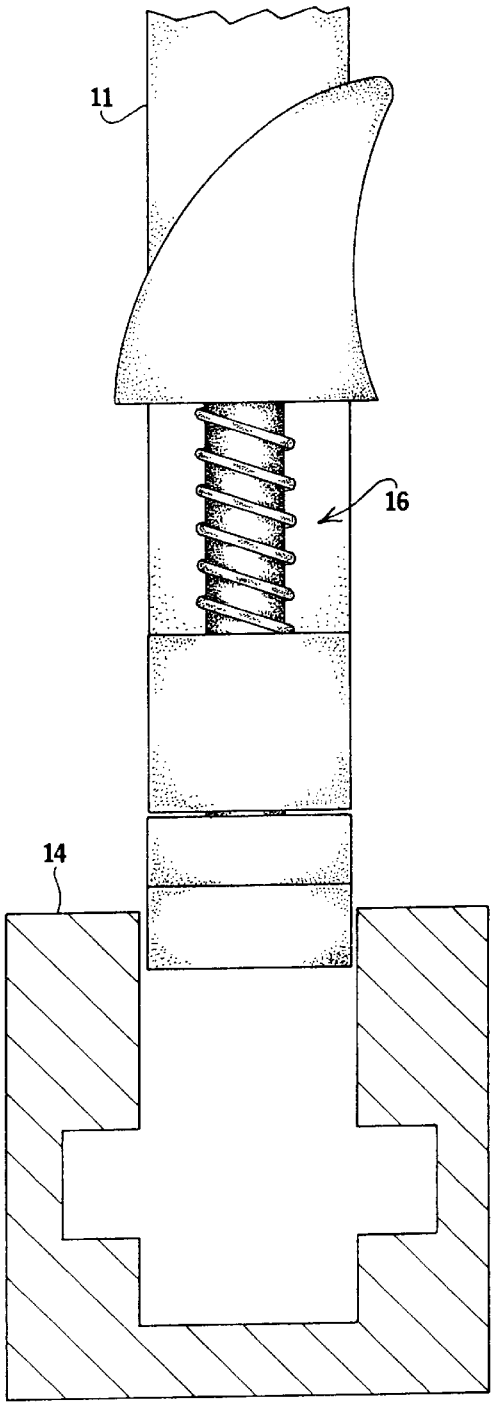
FIG. 5 is a cross sectional view, similar to FIG. 4, such that with the base lock unlocked, the fin can be removed from the fin box.

FIG. 5 illustrates the fin 11 being vertically removed from the fin box 14. With the locking mechanism 16 still in the free position, the fin 11 and the entire locking mechanism 16 can move upward through the vertical channel 17 until the fin 11 is clear of the surfboard. Then, reinstalling the fin 11 into the fin box 14 simply involves reversing the steps performed in FIG. 2 through FIG. 5.

In conclusion, herein is presented a surfboard quick fin release system which employs a fin box having a longitudinal channel which allows the fin to be adjusted in its longitudinal position therein, wherein the fin has a locking mechanism which selectively secures the fin within the channel, and selectively allows the fin to be repositioned along the channel or quickly removed from the channel by simply pressing downward and rotating its release handle.

What is claimed is:

1. A surfboard fin release system, for use in attaching a fin to a surfboard, the fin having a tang and a fin width, and the surfboard having a top surface, comprising:

a fin box having a longitudinal channel extending longitudinally along the surfboard; the fin box having a box top; the fin box submerged within the surfboard with the fin box flush with the surfboard top; the longitudinal channel extending through the fin box top;

a locking mechanism located on the tang of the fin; the locking mechanism having a locking base which selectively secures in the longitudinal channel of the fin box for fixing the fin to the surfboard; and wherein the longitudinal channel further comprises a vertical channel and a horizontal channel having a horizontal channel top, which together form a plus shaped cross-sectional longitudinal channel, and wherein the locking base has a base flange which selectively extends into the horizontal channel to lock the fin inside the fin box.

2. The surfboard fin release system as recited in claim 1, wherein the locking mechanism further comprises a main shaft extending vertically through the tang, a release handle fixed to the main shaft above the tang, and wherein the locking base is fixed to the main shaft beneath the tang.

3. The surfboard fin release system as recited in claim 2, wherein the locking mechanism further comprises a coil spring which extends around the main shaft between the release handle and the tang, such that the coil spring pushes upward against the release handle, urging the main shaft upward, thus pulling the base flange upward against the horizontal channel top.

4. The surfboard fin release system as recited in claim 3, further comprising a roll pin extending through the locking base and the main shaft to vertically and angularly fix the locking base and main shaft, the release handle also angularly fixed to the main shaft such that the main shaft may be rotated angularly by rotating the release handle to turn rotate the locking base and free the base flange from the horizontal channel to allow the fin to be pulled vertically upward free of the fin box.

5. The surfboard fin release system as recited in claim 4, wherein the main shaft does not extend below the locking base.

6. A surfboard fin release method for releasably attaching a surfboard fin to a surfboard having a fin box having a longitudinal channel, the fin having a locking mechanism comprising a locking base having a locking base flange, the longitudinal channel including a vertical channel and a horizontal channel having a horizontal channel top, comprising the steps of:

inserting the locking base into the longitudinal channel;

twisting the locking base so that the base flange extends into the horizontal channel; and fixing the fin in place by biasing the base flange upward against the horizontal channel top.

7. The surfboard fin release method as recited in claim 6, the fin having a fin tang, the locking mechanism further having a main shaft extending vertically through the fin tang, a release handle fixed to the main shaft above the tang, a spring extending on the main shaft between the release handle and the tang, the locking base fixed to the main shaft below the tang, and wherein the step of biasing the base flange upward against the horizontal channel top further comprises:

pushing against the release handle by the spring; and pulling the base flange upward against the horizontal channel top by the main shaft.

8. The surfboard fin release method as recited in claim 7, wherein the release handle and the locking base are both vertically and angularly fixed to the main shaft, and wherein the step of twisting the locking base further comprises rotating the release handle.

9. The surfboard fin release method as recited in claim 8, wherein the method as recited further comprises one of the steps of:

repositioning the fin by:

pressing downward upon the release handle, sliding the fin along the longitudinal channel, and disengaging the release handle; and removing the fin by:

pressing downward upon the release handle, rotating the release handle until the base flange does not extend into the horizontal channel, and pulling the fin upward until said fin is free of the fin box.

* * * * *